US005503245A

United States Patent [19]

Etesam

[11] Patent Number: 5,503,245

[45] Date of Patent: Apr. 2, 1996

[54] STEP LADDER

[75] Inventor: Mehran Etesam, Swainsboro, Ga.

[73] Assignee: Keller Industries, Inc., Ft. Lauderdale, Fla.

[21] Appl. No.: 307,518

[22] Filed: Sep. 16, 1994

[51] Int. Cl.[6] ..... E06C 1/00

[52] U.S. Cl. ..... 182/129; 182/46

[58] Field of Search ..... 182/129, 46, 165, 182/173; 248/210, 238

[56] References Cited

U.S. PATENT DOCUMENTS

| | | | |
|---|---|---|---|
| D. 300,252 | 3/1989 | Schmitt | D25/68 |
| D. 310,884 | 9/1990 | Patton et al. | D25/68 |
| D. 340,773 | 10/1993 | Bartnicki et al. | D25/68 |
| 1,379,419 | 5/1921 | Reeves . | |
| 2,109,886 | 3/1938 | Lewis | 228/17 |
| 2,425,025 | 8/1947 | Boisselier | 228/58 |
| 2,444,096 | 6/1948 | Faust | 248/238 X |
| 2,930,442 | 3/1960 | Carter | 182/120 |
| 3,010,535 | 11/1961 | Depiano | 182/129 |
| 3,106,987 | 10/1963 | Lerner | 182/126 |
| 3,584,702 | 6/1971 | Lang | 182/129 X |
| 4,023,647 | 5/1977 | Confer | 182/108 |
| 4,261,435 | 4/1981 | Winter | 182/129 |
| 4,601,364 | 7/1986 | York | 182/187 |
| 4,874,147 | 10/1989 | Ory et al. | 248/210 |
| 4,979,590 | 12/1990 | Bailey | 182/106 |
| 5,031,723 | 7/1991 | Hooten | 182/129 |
| 5,259,480 | 11/1993 | Bartnicki et al. | 182/173 |

*Primary Examiner*—Alvin C. Chin-Shue
*Attorney, Agent, or Firm*—Eckert Seamans Cherin & Mellott

[57] ABSTRACT

A step ladder includes legs and a ladder top connected to the ladder legs. The ladder top is molded integrally from a polymer material and has an inverted-cup shape defined by a generally rectangular central web with a periphery and peripheral flanges extending generally down from the periphery. The web defines a platform of the ladder top on which articles such as tools and paint cans can be placed. The web has a pair of eye-loops protruding up from a plane common with the platform, these eye loops being spaced and arranged for removably receiving a pair of hooks on a conventional roller paint-pan so as to support the paint-pan on the top surface of the platform.

11 Claims, 3 Drawing Sheets

STEP LADDER

BACKGROUND OF THE INVENTION

1. Field of the Invention

The invention relates to a step ladder with ladder legs and a ladder top or platform, foldably connected to the ladder legs and arranged to receive certain tools. The step ladder can be opened into an A-frame state in which it is free standing. The ladder top is molded from a hardenable flowable material such as a curable polymer forming a rigid shape. The ladder top generally comprises an inverted cup shape having a flat central web serving as the platform for placing articles such as tools, paint brushes, containers of paint and so on. The web has a periphery formed with mined-down flanges and an underside formed with ribs that extend between and interconnect the flanges, wherein the flanges and ribs coact to stiffen and/or strengthen the ladder top. The top side of the web has a pair of protruding eye-loops that are spaced and arranged for removably receiving a pair of hooks on a roller pan such that the pan can be cantilevered over the edge of the platform, away from the step side of the ladder.

2. Prior Art

Step ladders are popular in residential and commercial environments to enable users to reach higher on walls, ceilings or the like, for various chores and activities. When not in use, step ladders are folded up or collapsed, to be stored in a closet, hung on a wall hook or the like. Step ladders have pivotable structures connecting the ladder legs for movement between the collapsed flat storage position and an A-frame use position, with means provided to limit opening of the legs to a predetermined angle. Advantageously, the pivoting structure includes a platform or ladder top, which provides a surface on which items can be rested. Ladder tops are arranged with sufficient strength to withstand loads induced by a user standing on a step of the ladder during use. Although not preferred for reasons of stability and safety, the ladder top is typically strong enough that a person can stand on top of it as well. A step ladder, including its ladder top, should be durable and strong to remain stable over a long useful life, but also must be economical.

Ladder tops can include auxiliary features that supplement the basic function of pivotably connecting the ladder legs and forming a platform or top-most step. For example, ladder tops are known with formed holes for receiving and holding the shafts or handles of screwdrivers, hammers, paint brushes and so on.

Various materials can be used for ladder legs, steps and tops. It is known to fabricate ladder tops in a molding process from flowable material that hardens in a relatively rigid shape, such as a thermoset or thermoplastic curable resin, for obtaining a molded ladder top. Molded ladder tops have various advantages over other ladder tops, such as ladder tops stamped from aluminum or made of wood. Polymer material is very inexpensive. It is easily formed to shape, including integrally formed flanges, surface features, tool storage apertures and other aspects that are useful in a ladder top. A polymer ladder top can be made as strong or stronger than stamped a metal one, is comparably light in weight, and is less expensive to manufacture than a stamped and folded sheet metal top. One way to achieve comparable strength is to provide the polymer ladder top with stiffening and/or strengthening elements, such as flanges and ribs, that are less prominent in metal stamped ladder tops.

A polymer ladder top, for example, typically has an overall shape of an inverted-cup, including a central web with a rectangular periphery and depending flanges at the periphery, the flanges being smoothly joined to define a continuous generally-rectangular shape in plan view. Additionally, the typical polymer ladder top includes ribs formed on an underneath side of the web, extending between and intersecting the flanges at oblique angles to further stiffen and/or strengthen the ladder top.

A stamped metal ladder top also typically has peripheral flanges, bent downwardly from a flat sheet and lapped at the corners for attachment with rivets. The flanges of the typical polymer ladder top are relatively larger than stamped metal ones, more particularly being relatively longer-extending and/or thicker than their sheet metal counterparts. The ends of metal flanges can be rolled or folded back to avoid sharp edges, but otherwise strengthening ribs are not employed in metal stamped ladder tops, particularly under the flat central web part of the ladder top.

Step ladders are often used for painting, and can have a pivotable shelf below the ladder top for supporting a paint can. Advantageously, the ladder top and/or the shelf is dimensioned such that a paint roller tray can be secured thereto by the hooks provided on the tray. The hooks of a typical roller tray are provided on the underside of the tray at the higher edge of a sloping end of the tray, for example extending downwardly to a plane common with the bottom of the tray on an opposite, deep end, where the hooks are bent to a right angle. The hooks function as feet when the tray is rested on a flat surface or as hooks when the tray is cantilevered from the edge of a shelf or other surface by grasping the bent ends of the hooks around the underside of the shelf or the like.

Paint roller trays can have two sets of tabs at different vertical positions, one for engaging under the edge of a short thin shelf (e.g., 0.75 inch or 2 cm) and the other for resting vertically on a horizontal surface. It may be convenient depending on the vertical level at which one is painting, to use a paint roller engaged on the pivoting shelf of a step ladder. In situations where the user is higher on the ladder, however, bending over to the shelf to coat the paint roller is not convenient. It is more comfortable in that case to have the roller tray mounted higher as well, namely on the top of the ladder.

The long depending flanges of a molded polymer ladder top typically extend too far downwardly to be encompassed by the hooks of the roller tray, which have a clearance of about two inches (5 cm) from the underside of the tray at the sloping end. The hooks are not long enough to clear the lower terminal edge of the associated flange of the ladder top. Thus, a conventional roller paint-pan cannot be used with a polymer ladder top unless some solution is achieved.

One possibility is to make the flange much thicker to achieve the necessary strength and stiffness. This is not preferred. Another solution has involved forming openings the front one of the depending flanges, the openings being placed below the plane of the web and spaced and arranged to receive the hooks of the conventional roller pan. This weakens the top in that openings are provided in the front flange, and portions of the stiffening ribs on the underside of the web must be eliminated to provide clearance for the paint pan hooks.

Forming holes in the front flange is not a wholly satisfactory solution. The holes are necessarily located at least somewhat lower than the top surface of the ladder top, which causes the tray to tilt back relative to horizontal. It would be more appropriate to tilt, if at all, toward the deep end of the tray, and thereby to better guard against spillage over the shallower edges. Moreover, the disadvantages of weakening the ladder top by holes in the flange and stiffening ribs arguably outweigh the advantage of providing a receptacle for the paint tray. The load-carrying function of the ladder top preferably should not be diminished for reasons of safety and durability.

What is needed is an improved configuration of a polymer ladder top, in particular a configuration that securely receives a roller pan at a desirable orientation, and that does not adversely affect the strength and durability of the ladder top, nor unduly increase its cost.

SUMMARY OF THE INVENTION

It is an object of the invention to provide a molded or polymer ladder top that is shaped to permit use with a conventional roller paint-pan without adversely affecting strength and durability.

It is a further object of the invention to provide the above ladder top with a pair of eye loops that protrude up from the top surface of the ladder top, which eye loops are spaced and arranged to receive a pair of hooks of a conventional roller paint-pan.

It is another object of the invention that the above eye loops are placed at locations where the eye loops do not detract from the load-carrying functions of other elements of the ladder top, such as stiffening ribs or flanges and the like that depend from the central web of the top.

These and other aspects and objects are provided according to the invention in a step ladder that includes ladder legs and a ladder top pivotally connected to the ladder legs. Preferably the step ladder is positionable between an A-frame use position and a collapsed flat storage position. The ladder top is molded from a flowable preferably-curable polymer material that hardens in a relatively rigid shape, and has an inverted-cup shape defined by a central web with a periphery and peripheral flanges extending generally down from the periphery. The web defines a platform of the ladder top on which articles such as tools and paint cans can be placed. The web is formed with a pair of preferably integral eye-loops that protrude up from the plane of the platform, these eye loops being spaced and arranged for removably receiving a pair of hooks of a conventional roller paint-pan such that the horizontal portions of the hooks rest substantially on the top surface of the ladder top.

The flanges are smoothly and preferably integrally joined together at corners to define a continuous peripheral flange structure or skirt that is turned-down at the periphery of the web. The flanges increase the overall strength and stiffness of the ladder top. A from one of the flanges, i.e., facing toward the step side of the ladder to be occupied by the user, can have a terminal lower edge that is spaced too far below the web to be encompassed by the hooks of the paint tray or pan; however, the hooks can be received by the eye loops and correctly orient the tray or pan for use.

The ladder top preferably includes ribs formed integrally with the web and flanges, in a pattern extending downwardly under the web. The ribs can extend between and intersect the flanges at oblique angles, and further increase the strength and stiffness the ladder top due to the formation of closed triangular supporting structures. The ladder top optionally is formed with at least one or more openings in the web, which openings permit a user to temporarily store a given tool by its handle or shaft, such as paint brushes, hammers, screwdrivers and the like.

Preferably, at least one of a front pair and a back pair of legs are pivoted to the ladder top and a limiting structure that may include the ladder flanges limits the angle to which the legs can be pivoted apart. Ideally one of the two pair of legs, such as the back pair, is pivotably connected to the ladder top and the other pair is attached rigidly to the ladder top. The ladder can be pivoted between a collapsed position where the legs are substantially abutted, to a supporting A-frame position for use. The ladder legs can be made of any suitable material, such as fiberglass, segments of an extruded polymer, wood, aluminum extrusions, and so on. The front ladder legs are spaced apart and carry a series of steps between them, and the rear legs can have diagonal trusses. A pivotable paint can shelf can be included as well. A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
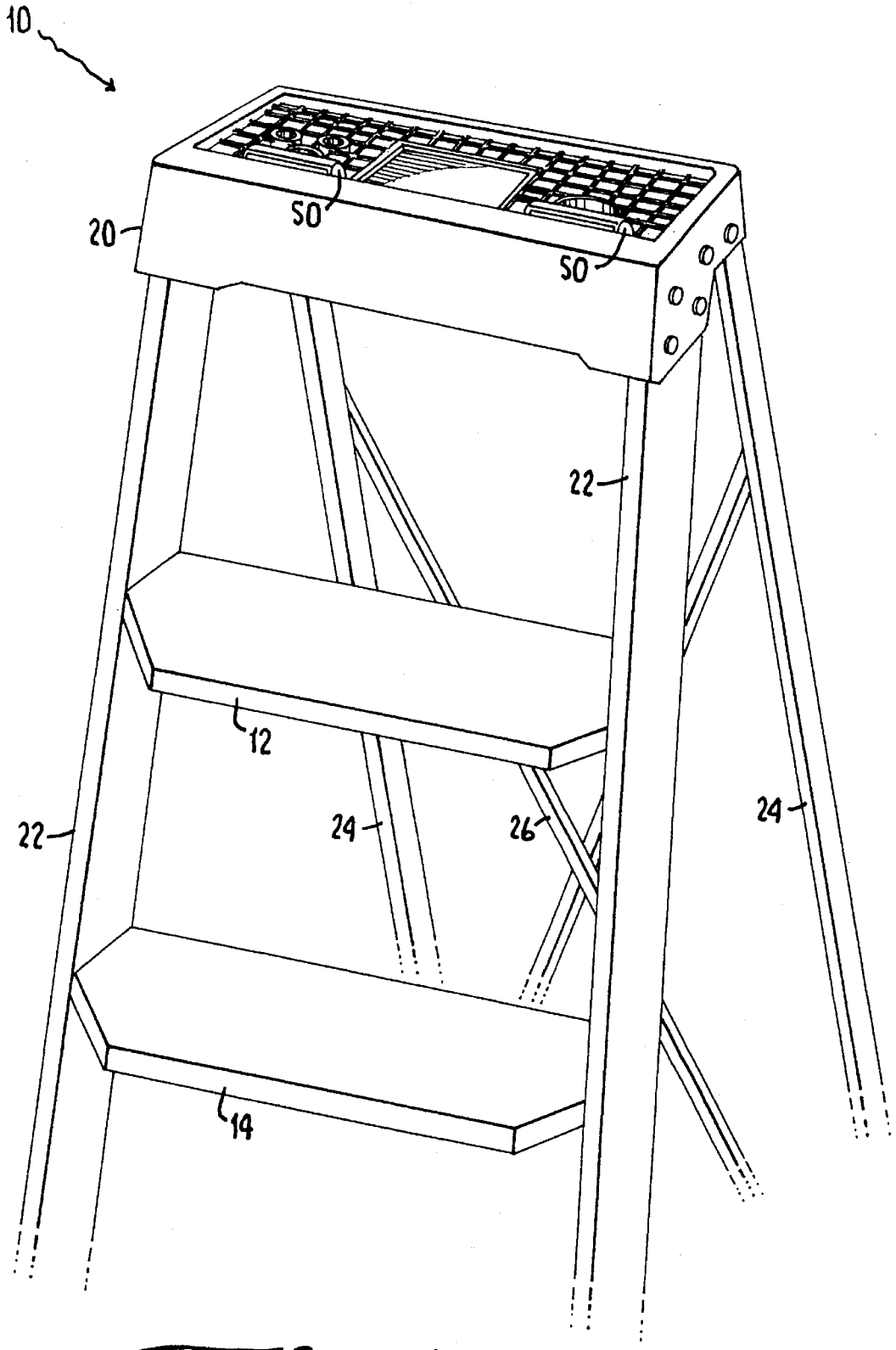
FIG. 1 is a partial perspective view of a step ladder according to the invention, with lower portions shown broken away.

In FIG. 1, a step ladder 10 according to the invention is free-standing on a support surface (not shown) in an A-frame position, as ready for a user to climb up on a series of steps 12, 14 and so on, of the ladder 10. The step ladder 10 is alternatively positionable in a collapsed flat storage position (not shown) with the opposed legs pivoted against one another, in which the step ladder 10 can be conveniently stored, e.g., hung out of the way on a wall hook (not shown) or the like.

Step ladder 10 comprises a ladder top 20 and ladder legs 22–24 attached to ladder top 20, the ladder legs including a front pair 22 and a back pair 24, respectively, the "front" legs supporting the steps on which a user can stand when using the ladder. The step ladder 10 has various uses not limited to the traditional use of standing on the steps of the front legs (e.g., it can be used as a leaning ladder when folded or as a member of a scaffolding arrangement when opened, etc.). Accordingly, terms like "top" and "bottom "; "front" and "back"; "above", "below" and "underneath "; and so on, refer to the traditional use of the ladder. Such terms are merely for convenience in describing the ladder structure, and not to limit the use and/or deployment of the step ladder 10.

The steps 12/14 are attached between the front pair of ladder legs 22. Braces 26 cross in the back between the back pair of ladder legs 24 to stabilize the parallel relationship between the back pair of legs 24. The front pair of ladder legs 22 are fixed rigidly to the ladder top 20 by rivets or similar fasteners. The back pair 24 are preferably pivotably connected to the ladder top 20, for example using looser fitting rivets, to give the step ladder 10 the feature of being foldable or unfoldable to a selected position between the A-frame use position (FIG. 1) and the collapsed flat storage position (not shown) in which the back pair of ladder legs 24 abut the front pair 22.

The ladder top 20 preferably is made as a single integral unit and is preferably molded from a flowable material that hardens in a relatively rigid shape, more preferably a curable polymer material. With general reference to FIGS. 3–7, the ladder top 20 has an generally inverted-cup shape that is rectangular in plan view, defined by a central web 30 with a rectangular periphery 32 and peripheral flanges 34 extending down from the rectangular periphery 32. The web 30 defines a rectangular platform 36 of ladder top 20, on which articles such as tools and paint cans (not shown) can be placed at a convenient location to be reached while working. Web 30 is formed with a central depression 42 that can be used for labeling the ladder (e.g., as to load capacity or a warning not to stand on the top step or platform, etc.), and for serving as a receptacle in which loose fasteners and the like can be kept without rolling off the platform. Web 30 is optionally formed with at least one and preferably several openings 44, which permit a user to temporarily store a tool by its shaft or handle, such as paint brushes, hammers, screwdrivers and the like (none being shown).

Figure 2:
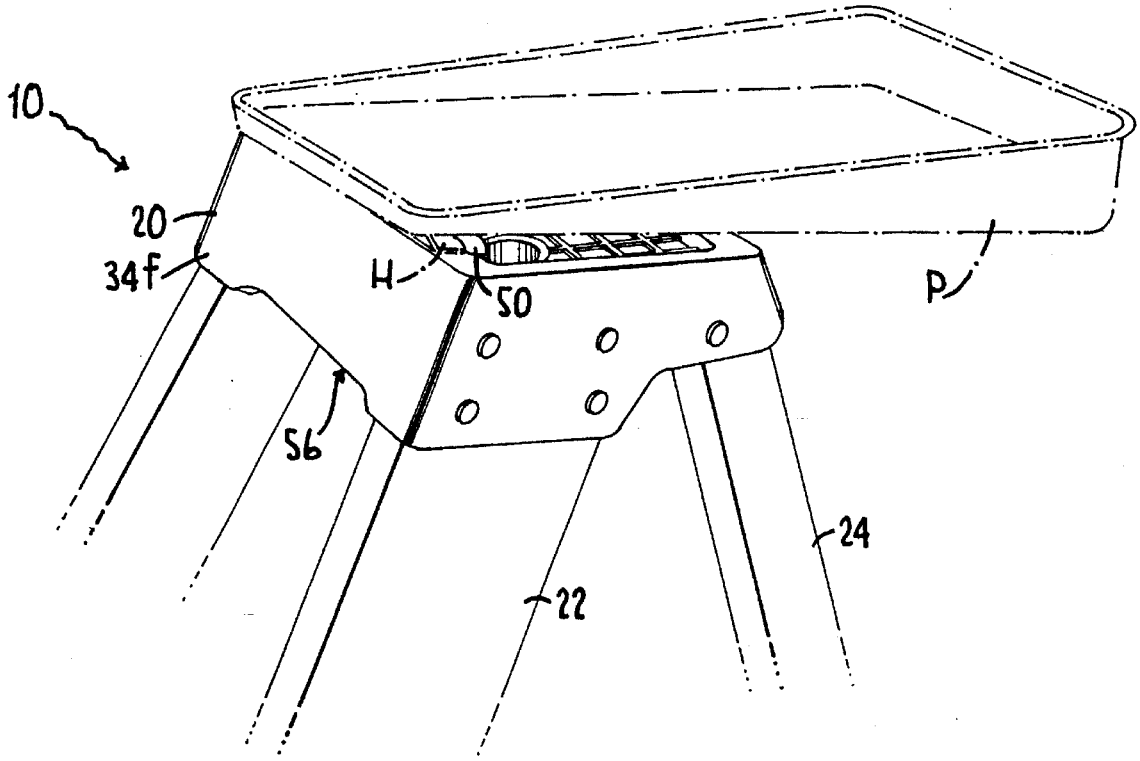
FIG. 2 is a perspective view thereof from a vantage point positioned more to the right than in FIG.1, wherein a roller paint-pan is shown in broken lines.
Figure 3:
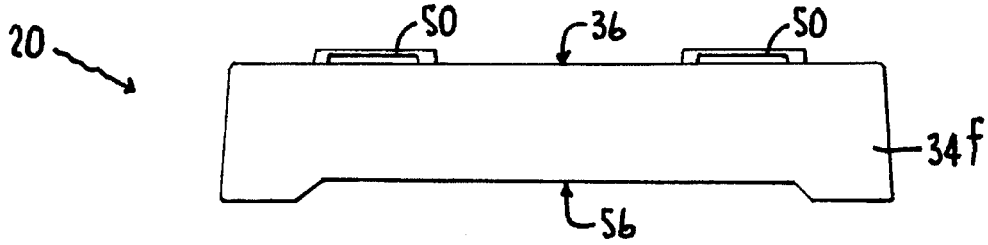
FIG. 3 is a front elevation view of the ladder top of the step ladder.
Figure 5:
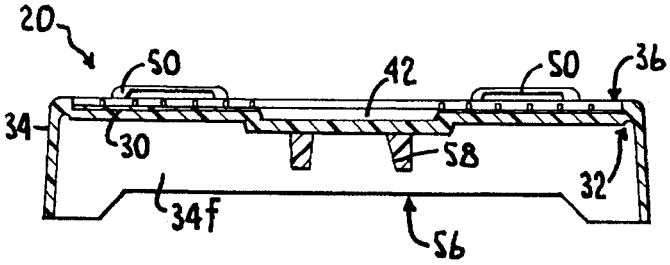
FIG. 5 is a section view taken along line V—V in FIG. 4.

An inventive aspect of the step ladder 10 and ladder top 20 is a pair eye-loops 50 that protrude up from the plane of the platform 36 (see FIGS. 3 and 5). As shown by FIG. 2, these eye loops 50 are spaced and arranged for removably receiving a pair of hooks H on a conventional roller paint-pan P. Inasmuch as eye-loops 50 are raised from the surface of platform 36, the lower surfaces of hooks H, which would support the pan as legs if the pan were placed on the ground or other horizontal surface, are disposed in the plane of the top surface of platform 36.

With reference again to FIGS. 3–7, peripheral flanges 34 are smoothly joined together at corners 54 to define a continuous peripheral structure or skirt 34 for web 30, which structure or skirt 34 extends generally downwardly from the periphery 32 of web 30. Flanges 34 act to increase the overall strength and stiffness of the ladder top 20. Preferably, the flanges 34 extend lower than the flanges of a comparable sheet metal ladder top, which helps to support the ladder structure notwithstanding the more flexible nature of typical polymer material. One of the flanges **34*f* (FIGS. 3 and 5) thus has a terminal lower edge 56 that is spaced too far below web 30 on the upper surface of platform 36, that the roller paint-pan hooks H (see FIG. 2) too short to hook under lower edge 56. Thus the paint pan P and its hooks H are exclusively limited to mounting on eye-loops 50 of ladder top 20, and otherwise the pan rests against the opposite edge of platform 50** at a point on the paint pan spaced from hooks H.

Ladder top 20 has a framework of ribs 58 (FIGS. 5 and 7) formed on the underside of web 30. Ribs 58 extend between and intersect flanges 34, preferably at oblique angles, and also intersect one another to define an X-shape. Ribs 58 further increase the strength and/or stiffness of ladder top 20.

Figure 4:
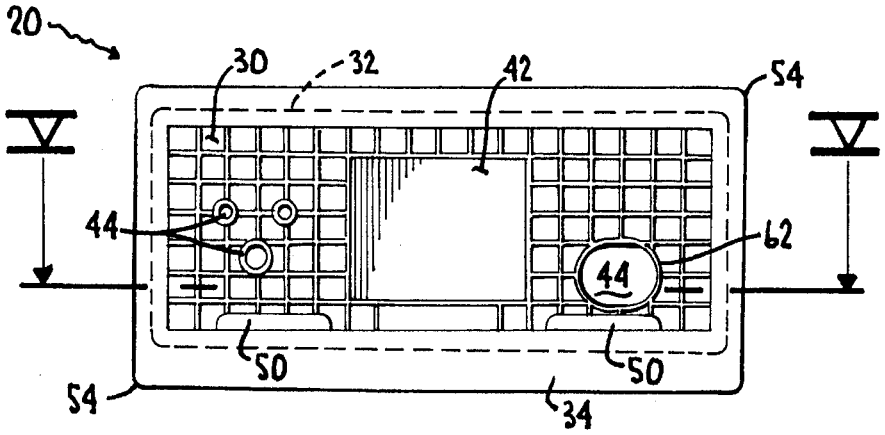
FIG. 4 is a top plan view thereof.
Figure 7:
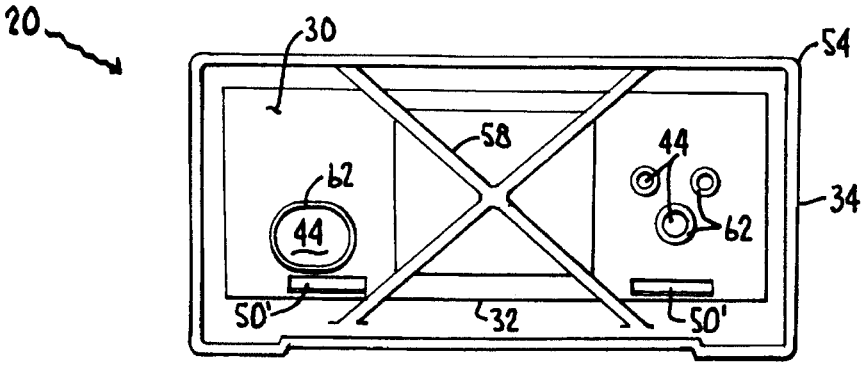
FIG. 7 is a bottom plan view thereof.

FIG. 7 shows that eye-loops 50 in web 30 result in nominal openings 50'. FIGS. 4 and 7 show that openings 44, excluding the eye-loop openings 50', are also provided with peripheral strengthening flanges 62. The flanges and ribs compensate for material missing at openings 44 in web 30 and so avoid diminishing the overall strength and stiffness in the ladder top 20 due to the holes. In the embodiment shown, openings 50' of eye-loops 50 do not have peripheral flanges, but are located and arranged with respect to the main flanges 34 and ribs 58 in such selected positions that the structural integrity of the ladder top 20 as a whole is maintained. More particularly, eye loops 50 and their openings 50' are disposed adjacent to a stepped edge of the web adjacent periphery 32, and at the margin of a central area where shallower ribs are provided (for traction as well as stiffness) on the upper surface of web 30 (see FIGS. 4 and 5).

Figure 6:
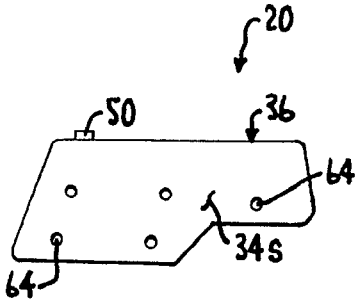
FIG. 6 is a side elevation view of the ladder top.

In FIG. 6, a side flange **34*s* of the ladder top 20 (the opposite side being a mirror image) is formed with a series of holes 64 for connecting the ladder legs 22–24. Preferably one of the two pairs of ladder legs 22–24 is pivotably connected to the ladder top 20, and the other is rigidly connected. The pivotably connected pair can be, as shown in the figures, the back pair 24. Pivotably connecting one or the other pairs of ladder legs 22–24 provides the step ladder 10 with the feature of being alternatively positionable between the A-frame use position and the collapsed flat storage position. Ladder legs 22–24** can be made of any suitable material, such as fiberglass, segments of extruded polymer, wood, aluminum extrusions, and so on.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A step ladder comprising:

a ladder top, integrally formed from a moldable material that hardens in a substantially rigid shape, having an inverted-cup shape defined by a central web with a periphery and peripheral flanges extending generally down from the periphery, wherein the web defines a platform and the web is formed with a pair of loop portions that protrude up from a plane of the platform, said loop portions being spaced and arranged for removably receiving a pair of hooks on a conventional roller paint pan; and, ladder legs attached to the ladder top to form said step ladder.

2. The step ladder of claim 1, wherein the flanges are smoothly joined together at corners to define a continuous peripheral structure for the ladder top that extends down from the periphery of the web for strengthening and stiffening the ladder top.

3. The step ladder of claim 2, wherein a one of the flanges is a front one that has a terminal lower edge, said one of the flanges having a length exceeding a span of hooks of a roller paint-pan, such that the paint pan is mountable exclusively to said loop portions of the ladder top.

4. The step ladder of claim 2, wherein the ladder top further includes ribs on an underside of the web for further strengthening and stiffening the ladder top, said ribs extending between and intersecting the flanges.

5. The step ladder of claim 1, wherein the web is formed with at least one opening that permits removable passage of one of a shaft and a handle of a tool.

6. The step ladder of claim 1, wherein at least one of the legs is pivotably connected to the ladder top such that said step ladder is openable into an A-frame use position and collapsible into a flat storage position.

7. The step ladder of claim 6, wherein the ladder legs comprise at least one of fiberglass material, segments of an extruded polymer, wood, and aluminum.

8. The step ladder of claim 1, wherein the ladder legs include a pair of front ladder legs and a pair of back ladder legs, and further comprising a series of steps coupled between the front ladder legs.

9. In combination, a roller paint-pan and a step ladder, comprising:

the roller paint pan comprising: a deeper end and a shallower end, and hooks disposed on a bottom of the shallower end for supporting the paint pan on a horizontal surface and for hooking the paint pan under an edge of a structure having a width less than a span of the hooks;

the step ladder comprising: a ladder top, integrally formed from a moldable material that hardens in a substantially rigid shape, having an inverted-cup shape defined by a central web with a periphery and peripheral flanges extending generally down from the periphery, wherein the web defines a platform and the web is formed with a pair of loop portions that protrude up from a plane of the platform, said loop portions being spaced and arranged for removably receiving the hooks of the paint pan, and, ladder legs attached to the ladder top to form said step ladder.

10. The combination of claim 9, further comprising steps extending between a pair of the ladder legs, and wherein the loop portions are arranged on a side of the ladder top adjacent said pair of the ladder legs with the steps.

11. The combination of claim 9, wherein the web includes a stepped edge and the loop portions are disposed adjacent to the stepped edge.

* * * * *